United States Patent [19]

Becker et al.

[11] 4,385,668

[45] May 31, 1983

[54] INNER PIPE SUPPORT ARRANGEMENT FOR DOUBLE-WALLED DRILL PIPE

[75] Inventors: Floyd W. Becker; Kare Asak, both of Calgary, Canada

[73] Assignee: Turbo Resources Ltd., Calgary, Canada

[21] Appl. No.: 237,934

[22] Filed: Feb. 25, 1981

[51] Int. Cl.[3] ..... E21B 17/18

[52] U.S. Cl. ..... 175/135; 175/215; 138/113; 285/138

[58] Field of Search ..... 175/135, 215, 320; 138/111-113, 114, 155; 285/138, 139, 140, 142, 143, 133 A, 302

[56] References Cited

U.S. PATENT DOCUMENTS

| | | | |
|---|---|---|---|
| 3,473,618 | 10/1969 | Becker | 175/215 |
| 4,313,627 | 2/1982 | de Lange | 285/302 X |

FOREIGN PATENT DOCUMENTS

| | | | |
|---|---|---|---|
| 669302 | 8/1963 | Canada | 255/40 |
| 758467 | 5/1967 | Canada | 255/18 |
| 807546 | 3/1969 | Canada | 255/40 |
| 1034937 | 7/1970 | Canada | 255/24 |
| 857170 | 12/1970 | Canada | 255/24 |
| 1053656 | 5/1979 | Canada | 255/29 |
| 1065300 | 10/1979 | Canada | 255/28 |
| 1069494 | 1/1980 | Canada | 255/28 |
| 1076100 | 4/1980 | Canada | 255/28 |

*Primary Examiner*—Stephen J. Novosad
*Assistant Examiner*—Thuy M. Bui
*Attorney, Agent, or Firm*—Hayes, Davis & Soloway

[57] ABSTRACT

A double-walled drill pipe, having a plurality of outer pipe lengths connected end-to-end and a plurality of inner pipe lengths connected end-to-end and concentrically disposed within the outer pipes and defining an annular fluid flow passageway and a return flow passageway, is provided with an inner pipe support arrangement for minimizing stresses applied to the inner pipe lengths when blows are applied to the outer pipe lengths to drive a cutting bit. Each outer pipe length is provided with a ledge on its inner surface to provide a seat for an abutment on the outer surface of its adjacent inner pipe. When a blow is applied to the outer pipe lengths, the outer pipe is forced downwardly but due to inertial effects, the inner pipe unseats and is permitted to fall under its own weight. A resilient shock ring may be positioned on the length to cushion the fall of the inner pipe and provision may be made to limit axial displacement between the inner and outer pipes.

10 Claims, 4 Drawing Figures

INNER PIPE SUPPORT ARRANGEMENT FOR DOUBLE-WALLED DRILL PIPE

The present invention relates in general to pipe construction for use in impact drilling and in particular to the manner of mounting an inner pipe to an outer pipe of a drill string whereby the weight of the inner pipe is taken by the outer pipe and the inner pipe is permitted to move axially relative to the outer pipe.

BACKGROUND OF THE INVENTION

Double-walled drill pipes or string as used in "reverse-flow" or "reverse-circulation" techniques have been in existence for many years. Generally they include a large number of outer pipes sections connected end-to-end. A cutting bit is attached to the lowermost section and an impact or percussion device at the surface applies impact blows to the outer pipes causing the drill bit to chip away at the rock or earth formation. A series of inner pipes, connected end-to-end are concentrically disposed within the series of outer pipes to define an annular fluid flow passage between the inner and outer pipes for forcing fluid such as air and/or water down to the cutting bit and a bore for returning the fluid and rock fragments to the surface.

It is known to support the inner pipe by rigidly securing it to the outer pipe. The difficulty with this practice is that the large loads applied to the outer pipe are inherently transmitted to the inner pipe. Since the inner pipe is not intended or designed to take any significant impact loads, fracture of the inner pipe and consequently breakdown of the system takes place.

With a view to avoiding problems of this type, Canadian Pat. No. 857,170 granted to Becker Drilling (Alberta) Ltd. on Dec. 1, 1970 discloses an arrangement whereby the inner pipe rests upon the cutting bit and is permitted to move axially relative to the outer pipe, means being provided to maintain concentricity as between the inner and outer pipe sections. The difficulty with this arrangement is that if the drill string becomes rather long, as they tend to do, the lowermost pipe members must bear the weight of those above them. Consequently, failure of the lowermost pipes takes place.

Accordingly, the prime object of the present invention is to provide a double-walled pipe arrangement which minimizes the stresses applied to the inner pipe either in the form of impact loads generated directly by the percussion device or indirectly by the weight of other inner pipes.

SUMMARY OF THE INVENTION

The present invention provides an inner pipe support arrangement whereby the weight of each inner pipe section is transferred directly to its adjacent outer pipe section and the inner pipe sections are permitted to move axially relative to the outer pipe sections when blows are applied to the outer pipe sections.

Generally, the present invention is defined as a pipe section for a percussion type drill string having a plurality of pipe sections secured end-to-end, the section comprising: an outer pipe member; an inner pipe member adapted to be concentrically disposed within the outer pipe member and define with the outer pipe member an annular fluid flow passage, the inner pipe member having a bore defining a return fluid flow passage; and suspension means in the annular passage for suspending the inner pipe member on the outer pipe member in an at rest position and permitting axial movement of the inner pipe member relative to the outer pipe member when a blow is applied to the outer pipe section so as to minimize stresses applied to the inner pipe member.

DETAILED DESCRIPTION OF THE INVENTION

Figure 1:
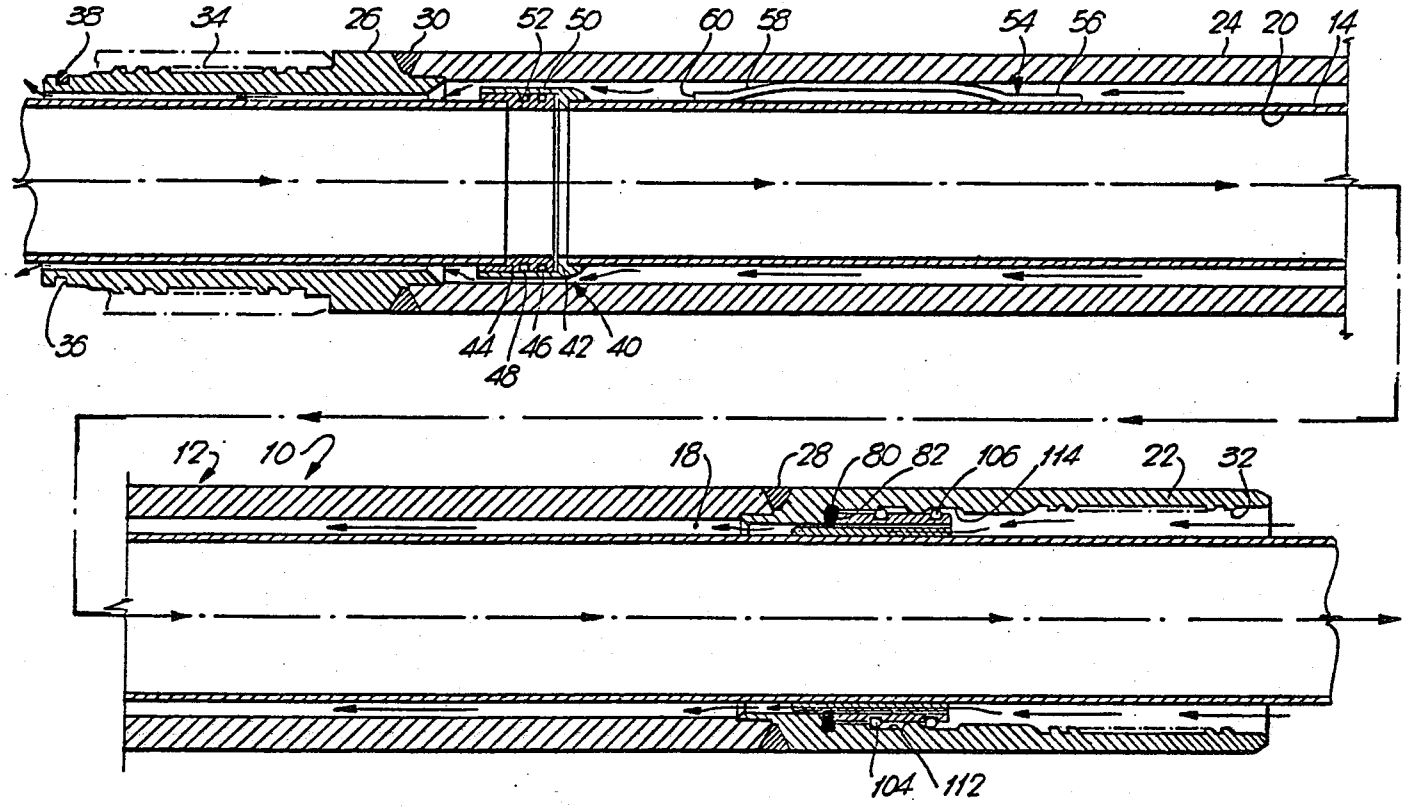
FIG. 1 is a longitudinal cross-sectional view of a section of a drill string.

FIG. 1 illustrates a section 10 of an impact drill string. The drill string is comprised of a large number of sections 10 connected end-to-end. A cutting bit (not shown) is connected to the lowermost section 10 in a well known manner while a drive means (not shown) is connected to the uppermost section 10 and applies thereto impact loads also in a well known manner. The cutting bit and drive means form no part of the present invention. The drill string is preferably of percussion type but may also be of the rotary-percussion type.

Each section 10 is generally comprised of an outer pipe and member 12 an inner pipe member or tube 14 and a suspension means 16 for suspending the inner pipe member on the outer pipe member in an at rest position but permitting the inner pipe member to move axially, upwardly relative to the outer pipe member (or the outer pipe member to move axially, downwardly relative to the inner pipe member) upon application of an impact load to the outer pipe member. Particulars of the suspension means 16 will be described later.

The inner pipe member 14 is concentrically disposed within the outer pipe member 12 and defines with the latter an annular fluid flow passageway 18 for an appropriate fluid, which may be either a liquid or a gas or both such as compressed air and water, downwardly to the cutting bit. The inner pipe member has a bore 20 which serves to return the fluid fed to cutting bit back up to the surface together with rock fragments and the like produced by the cutting bit.

It is the function of the outer pipe member to transmit the percussive or impact loads and any torque to the cutting bit while it is the function of the inner pipe to define the two fluid flow passageways within the outer pipe member.

The outer pipe member 12 is comprised of three coaxial components, namely a hammer box 22, a hammer pipe 24 and a pin 26. The box 22 is disposed upwardly of the hole relative to the pin. As illustrated in FIG. 1, the pipe 24 telescopingly receives a short section of each of the box 22 and pin 26 and is welded to each by welds 28 and 30.

The box 22 is formed with an internal thread 32 while the pin 26 is formed with an external thread 34 to threadably mate with thread 32 of box 22. Thus, box 22 threadably receives the pin of the adjacent pipe section. Pin 26 is further formed with a circumferential groove 36 sized to receive an O-ring 38 so as to provide a fluid seal between the pin and box.

Adjacent ends of inner pipe members are connected together by a coupling arrangement 40 comprised of a female ring member 42 which telescopingly receives and is welded to the lower end of an inner pipe member. Member 42 also telescopingly receives a male ring member 44. The male ring member, in turn, telescopingly receives and is welded to the upper end of an inner pipe member. A pair of O-rings 46 and 48 seated in grooves 50 and 52 of member 44 provide a fluid seal between the female and male members 42 and 44 respectively. It is to be noted that the outer cylindrical surface of member 42 is spaced inwardly from the inner surface of the outer pipe so as to ensure continuity of passageway 18.

Three equally angularly spaced elongated leaf springs 54 (one is shown in FIG. 1) are disposed in passageway 18 for maintaining concentricity between the inner and outer pipes. The springs extend longitudinally of the pipes and are about 12 inches long, 3/16 inch thick and $\frac{3}{4}$ of an inch wide. An upper portion 56 (about $3\frac{1}{2}$ inches long) is flat and is secured as by welding to the outer surface of the inner pipe. The lower portion 58 is arcuate, having a radius of about 24 inches. The apex of portion 58 bears against the inner surface of the outer pipe. The free end 60 of the spring is rounded and engages the inner pipe.

Figure 3:
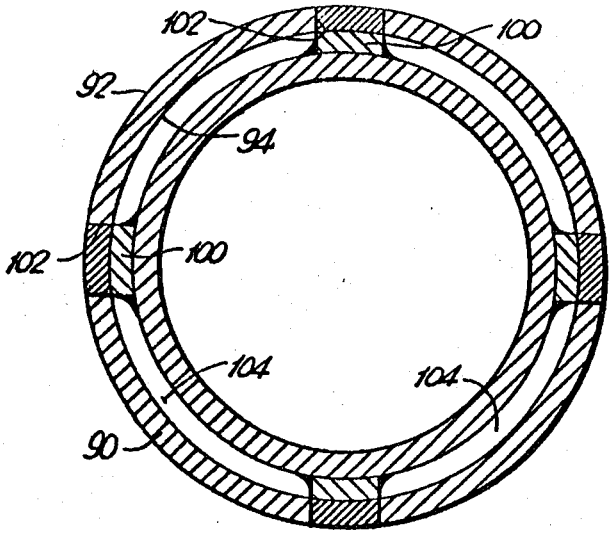
FIG. 3 is a cross-sectional view taken along line 3—3 of FIG. 2.
Figure 2:
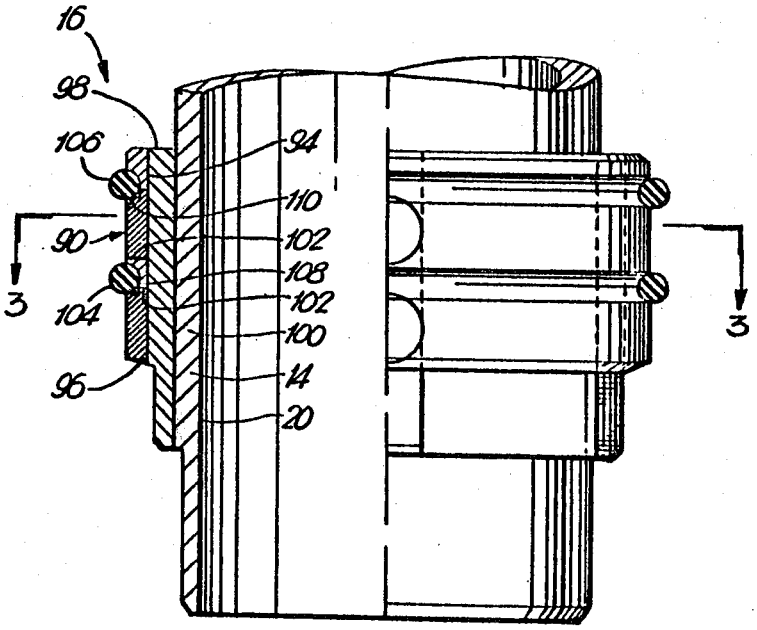
FIG. 2 is an enlarged longitudinal cross-sectional view illustrating a portion of the inner pipe suspension arrangement of the present invention.
Figure 4:
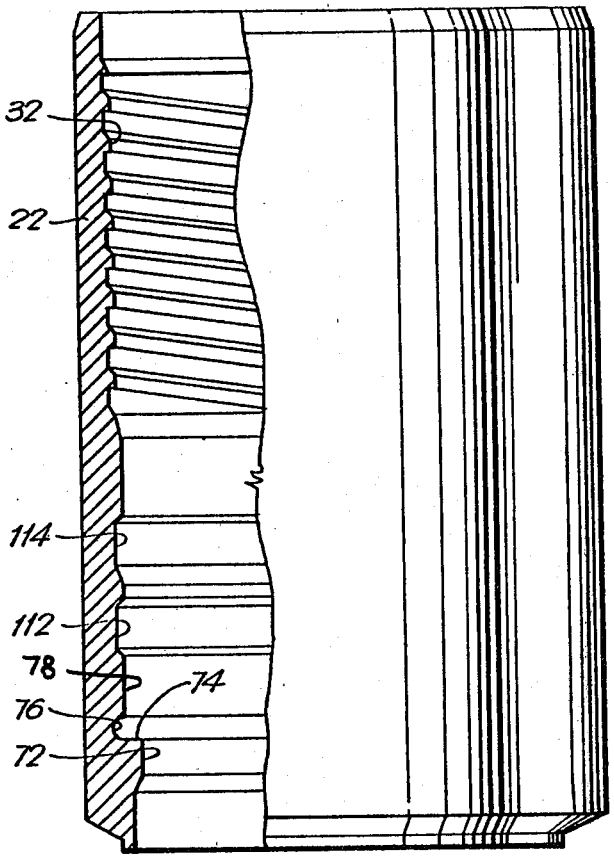
FIG. 4 is an enlarged cross-sectional view illustrating another portion of the inner pipe suspension means of the present invention.

Reference will now be made to FIGS. 2 and 3 which illustrate the means 16 for suspending the inner pipe on the outer pipe.

Generally, the suspension means includes a cylindrical sleeve concentrically disposed about and secured to the inner pipe and includes an annular abutment face formed to sit on an annular seat on the inner surface of the outer pipe. Travel limit means is also provided.

Specifically, the suspension means 16 is constructed and functions as follows.

The box 22 is formed with a reduced diameter section 72, adjacent its lower end, which defines an annular seat 74. A semi-circular, circumferential groove 76 is formed in the enlarged diameter portion 78 adjacent seat 74 for reception of a shock ring 80 formed of a relatively resilient material such as polyurathane. The outer circumference portion ring 80 is semi-circular while the opposed annular faces are generally flat and parallel but may converge inwardly toward one another. One face rests upon seat 74 while the outer face defines a seat 82 for abutting engagement with the abutment face of the sleeve. The ring extends radially inwardly slightly beyond the reduced diameter portion of box 22 for reasons which will become clear hereinafter.

Sleeve 90 has an outer cylindrical surface 92, an inner cylindrical surface 94, a lower end face 96 and an upper end face 98. Face 96 defines the abutment face. The diameter of the outer surface 92 is sized to be slightly less than the portion 78 of the box. Interposed between inner surface 94 and the outer surface of the inner pipe are four generally flat, longitudinally extending straps 100. The straps are welded to the inner pipe along their longitudinal edges. The sleeve is, in turn, plug welded to the straps via four pairs of holes 102. Thus, the straps serve to secure the sleeve 90 to the inner pipe and provide four fluid passages 104 between the inner pipe and sleeve for continuity of fluid passage way 18.

The straps extend downwardly beyond lower face 96 of the sleeve by an amount greater than the expected travel between the inner and outer pipes. The inner circumferential face of ring 80 is sized to bear against the outer surfaces of the straps. Thus, the straps also serve to maintain the ring in proper seating relation in groove 76.

A pair of O-rings 104 and 106 are seated in grooves 108 and 110 in outer surface 92 of the sleeve and extend into circumferential grooves 112 and 114 formed in the enlarged diameter portion of box 22. The width of grooves 112 and 114 define the limit of axial travel of inner pipe relative to the outer pipe. The edges of the lower groove 112 and the upper edge of groove 114 are cut at 45° while the lower edge of upper groove 114 is cut at 15° from the axial direction to facilitate assembly and minimize damage to the O-rings during assembly.

In assembly, the straps are welded to the inner pipe and thereafter the sleeve is slid over the straps and plug welded thereto. The O-rings 104 and 106 are installed onto the sleeve while the shock ring is seated in groove 76. The inner pipe is then inserted into the outer pipe.

In operation, the end face 96 of the sleeve sits on the shock ring. This transfers the weight of the inner pipe to the outer pipe. A blow to the outer pipe forces the latter downwardly. Inertial effects cause the inner pipe to remain stationary for a short period of time and as a result, the sleeve will become unseated from the shock ring. The O-rings 104 and 106 control the relative travel of the pipes by engagement with the upper edges of grooves 112 and 114. After a short period, the inner pipe will fall and the sleeve will reseat, the fall being cushioned by the shock ring 80.

It will be seen therefore the stresses applied to and strains experienced by the inner pipe are considerably reduced relative to those arrangements wherein the inner pipe is secured to the outer pipe or the entire weight of the inner pipe is borne by the cutting bit.

It is to be understood that the foregoing is a description of the preferred embodiment of the invention and that various modifications may be made within the spirit of the appended claims. For example, if a shock ring is provided, its shape need not be limited to that described and illustrated but may be any other appropriate shape such as square or rectangular. Further, if travel limit means are provided, they need not be the pair of O-rings described but may be a projection on the outer surface of the inner pipe riding in a longitudinal groove on the inner surface of the outer pipe.

What is claimed is:

1. A pipe section for a percussion type drill string having a plurality of pipe sections secured end-to-end, said section comprising:

an outer pipe member;

an inner pipe member adapted to be concentrically disposed within said outer pipe member and define with said outer pipe member an annular fluid passage, said inner pipe member having a bore defining a return fluid flow passage; and suspension means in said annular passage for suspending said inner pipe member on said outer pipe member in an at rest position and permitting limited axial movement of said inner pipe member relative to said outer pipe member when a blow is applied to said outer pipe sectin so as to minimize stresses applied to said inner pipe member, said suspension means including an annular seat on the inner surface of said outer pipe member abuttingly engageable with an annular surface concentric with said inner pipe member on a sleeve secured to the outer surface of said inner pipe member, defining said at rest position.

2. A pipe section as defined in claim 4, said suspension means further including means for limiting the relative axial movement.

3. A pipe section as defined in claim 1, said outer pipe member having at least one axially extending groove in its inner surface, said groove defining at least one limit of travel of said inner pipe member relative to said outer pipe member, and said sleeve including means extending into said groove and being moveable therealong upon movement of said inner pipe member relative to said outer pipe member.

4. A pipe section as defined in claim 1, said sleeve having a plurality of longitudinally extending strap portions projecting radially inwardly of the inner surface of said sleeve, said strap portions being secured to the outer surface of said inner pipe and defining between the inner surface of said sleeve and the outer surface of said inner pipe member a plurality of longitudinal fluid flow passages in serial relation to said annular flow passage.

5. A pipe section as defined in claim 1, said suspension means including a resilient ring disposed on the inner surface of said outer pipe member and defining said annular seat, said ring serving to cushion the fall of said inner pipe member following a blow to said outer pipe member.

6. A pipe section as defined in claim 5, said ring being made of polyethylene and a shore hardness of 70-D.

7. A pipe section as defined in claim 1, at least one circumferential groove opening in the inner surface of said outer pipe member;

an O-ring seated in the outer surface of said sleeve and extending into said outer pipe member groove;

said O-ring being disposed adjacent one circumferential edge of said groove in said at rest position and being moveable axially of said groove away from said edge toward an opposed circumferential edge of said groove upon relative movement of said inner and outer pipe members, said opposed circumferential edge define the extreme limit of travel of said inner pipe member.

8. A pipe section as defined in claim 7, said outer pipe member having two said grooves opening into said inner surface, each said groove being adapted to receive an O-ring seated in said sleeve.

9. A pipe section assembly for a percussion type drill string having a plurality of pipe sections connected end-to-end, a drill bit connected to the free end of the lower most pipe section and impact means at the upper end of said drill string for applying an impact load to said drill string, said pipe section comprising:

a drill pipe having a lower pipe end having an external thread, a box end having an internal thread for mating threaded engagement with the pin end of an adjacent pipe section, an inner surface and an outer surface;

an interior tube concentrically disposed within said drill pipe and having an outer surface and an internal axial bore defining a fluid flow passage and defining with said drill pipe an annular fluid flow passage;

resilient means for maintaining concentricity between said drill pipe and said outer tube; and suspension means in said annular passage adjacent said box end of said drill pipe for suspending said tube on said drill pipe in an at rest position and permitting axial movement of said tube relative to said drill pipe away from said at rest position upon application of an impact load to said drill pipe;

said suspension means comprising:

a sleeve concentrically disposed about said tube and having an inner surface, an outer surface a lower end and an upper end, said lower end having an annular abutment surface;

at least three elongated strap members interposed between the inner surface of said sleeve and the outer surface of said tube and providing at least three fluid flow passages, said strap members extending longitudinally of and being secured to said tube and said sleeve, said strap members extending downwardly beyond the lower end of said sleeve;

a resilient ring disposed on the inner surface of said drill pipe below said sleeve, defining a seat for abutting engagement with said abutment surface and said at rest position of said tube;

whereby upon application of an impact blow to said drill pipe, said pipe will move axially downwardly relative to said tube, said tube will be unseated and cushioned by said ring when it returns to its at rest position.

10. An assembly as defined in claim 9, further including means for limiting relative axial movement between said drill pipe and said tube.

* * * * *

UNITED STATES PATENT AND TRADEMARK OFFICE

CERTIFICATE OF CORRECTION

PATENT NO. : 4,385,668

DATED : May 31, 1983

INVENTOR(S) : Floyd Walter Becker and Kare Asak

It is certified that error appears in the above—identified patent and that said Letters Patent is hereby corrected as shown below:

Colmn 4, line 61 - The term "section" should be substituted for "sectin".

Column 5, line 1 - The number "1" should be substituted for "4".

Signed and Sealed this

Second Day of August 1983

[SEAL]

Attest:

GERALD J. MOSSINGHOFF

Attesting Officer

Commissioner of Patents and Trademarks